United States Patent [19]

McKane

[11] 4,248,544

[45] Feb. 3, 1981

[54] TUBULAR SCAFFOLDING COUPLING

[75] Inventor: John McKane, Balloch, Scotland

[73] Assignee: Scaffolding Components Limited, Glasgow, Scotland

[21] Appl. No.: 17,801

[22] Filed: Mar. 5, 1979

[30] Foreign Application Priority Data

Mar. 7, 1978 [GB] United Kingdom ..... 8936/78

[51] Int. Cl.[2] ..... E04G 7/00; F16B 7/04

[52] U.S. Cl. ..... 403/49; 403/191; 403/343

[58] Field of Search ..... 403/49, 187, 189, 191, 403/199, 201, 235, 350, 351, 352, 343, 409; 211/182; 182/178

[56] References Cited

U.S. PATENT DOCUMENTS

| | | | |
|---|---|---|---|
| 1,326,182 | 12/1919 | Cater | 403/191 |
| 2,583,368 | 1/1952 | French | 403/191 |
| 3,885,648 | 5/1975 | Beziat | 403/350 X |

FOREIGN PATENT DOCUMENTS

| | | | |
|---|---|---|---|
| 2439273 | 3/1976 | Fed. Rep. of Germany | 403/49 |

*Primary Examiner*—Wayne L. Shedd
*Attorney, Agent, or Firm*—Gerald J. Ferguson, Jr.; Joseph J. Baker

[57] ABSTRACT

A coupling for tubular scaffolding including a boss mounted on a standard by a pin or by welding and a wedge ring rotatably encircling and co-planar with the boss.

Radial insets in the boss combine with the ring to form apertures in which pegs are located, the pegs being attached to the ends of ledgers and transoms. The inner face of the wedge ring has sloping wedge surfaces in the vicinity of the apertures which alter the radial dimension of the apertures. Thus, when a peg is located in an aperture the wedge ring can be rotated to wedge the peg firmly in the aperture.

The problem existing prior to the invention was the difficulty of securing ledgers and transoms. This has to be done by screw couplings or by getting above the coupling in order to tighten it. The coupling of the invention can be operated from below, i.e. by a person standing on erected scaffolding.

6 Claims, 7 Drawing Figures

TUBULAR SCAFFOLDING COUPLING

This invention relates to couplings for tubular scaffolding.

A disadvantage of existing couplings for tubular scaffolding is the difficulty of overhead working when mounting the couplings on standards, and securing the ledgers and transoms thereto, particularly when they are located 6' above previous level.

It is an object of the present invention to provide a coupling which will obviate or mitigate the aforesaid disadvantage.

According to the present invention there is provided a coupling comprising in combination, a body member for location around a standard, a wedge ring member which is coplanar and rotatably associated with the body member, and a plurality of pegs, the body member having a central aperture for receiving the standard therethrough and a plurality of radially disposed insets which combine with the wedge ring member to form apertures to receive the pegs therein parallel to the central aperture, the wedge ring member having a wedging surface for engaging the pegs when the ring member is rotated into a wedging position and for disengaging the pegs when the ring member is rotated into a disengaged position.

Preferably said wedge ring member has a wedging surface which decreases the radial dimension of each radial aperture when the ring member is rotated into a wedging position.

Preferably also, the body member is mounted on a standard by means of a pin passing through diametral apertures in the body member and standard.

Preferably also, the wedge ring member has diametrically opposed slots in which the ends of the pin are located.

Preferably also, said pin is a spirol pin.

Preferably also, each peg comprises a shank and a head, the shank having a cross-section for location in the radial aperture and the head having a cylindrical extension extending at right angles to the shank for engaging a tubular ledger or transom.

Preferably also, the longitudinal axis of the shank is off set relative to that of the head.

An embodiment of the present invention will now be described, by way of example, with reference to the accompanying drawings, in which.

Figure 1:
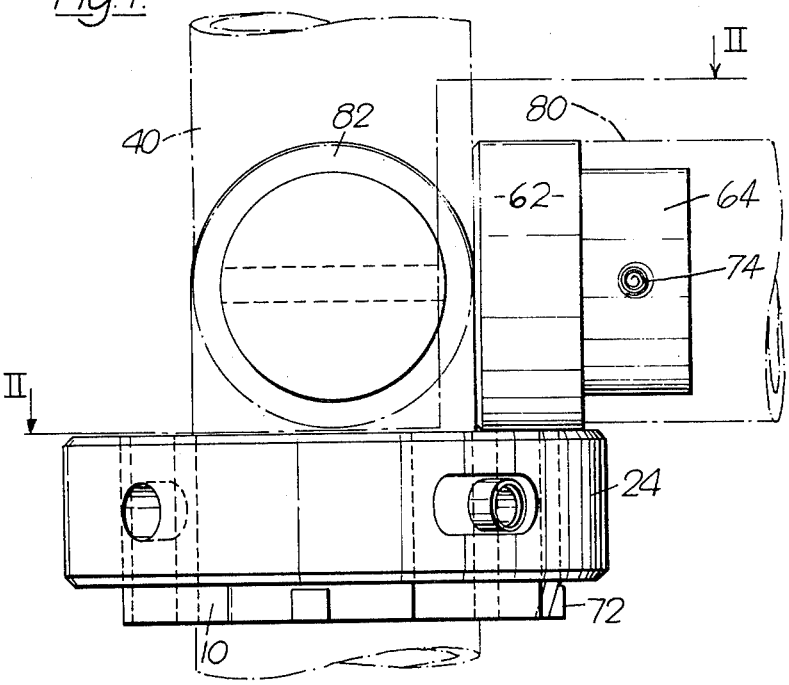
FIG. 1 is an elevation of the coupling according to the invention mounted on a standard and with a ledger and transom located therein.

Referring firstly to FIGS. 1 to 4, the coupling includes a body member or boss 10 having a central cylindrical passage 12 and four equi-spaced radially extending projections 14 which form between them four insets 16 of substantially U-shape in plan. The web 18 and one side 20 of each inset 16 are at right angles, and the other side 22 forms an angle greater than 90° with the web.

A wedge ring 24 is provided to encircle the boss 10 and co-operates with each inset 16 of the boss 10 to provide four equi-spaced radial apertures 30 parallel with the central passage 12 each to receive a peg 32 secured to one end of a ledger or transom as hereinafter described. The wedge ring has on its inner face 26, four radially inward extensions which form wedging surfaces 28.

The wedge ring 24 is rotatable about the boss 10, rotation in one direction, i.e. direction of arrow A being the "forward" or wedging direction. The inner face of each wedging surface 28 converges at one end towards the inner face 26 of the wedge ring, i.e. the radial thickness of each wedge decreases towards one end which is the "forward" end relative to the wedging movement of the wedging ring. The inner face of each wedging surface 28 is determined by scribing the inner diameter of the ring but from a centre which is slightly off set from the centre of the ring. As an illustration of this, the surface 28A (FIG. 4) has a radius r and a centre C.

Figure 2:
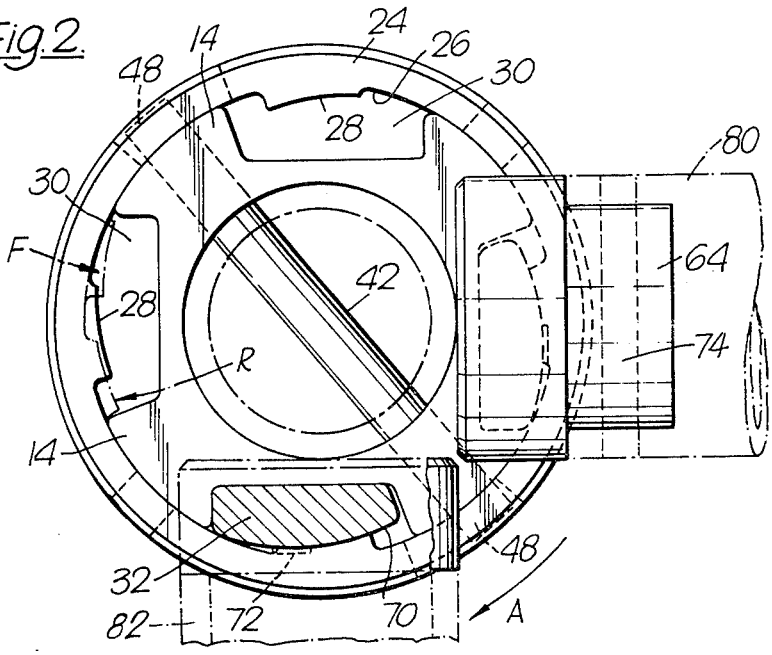
FIG. 2 is a plan view of the line II—II of FIG. 1.
Figure 3:
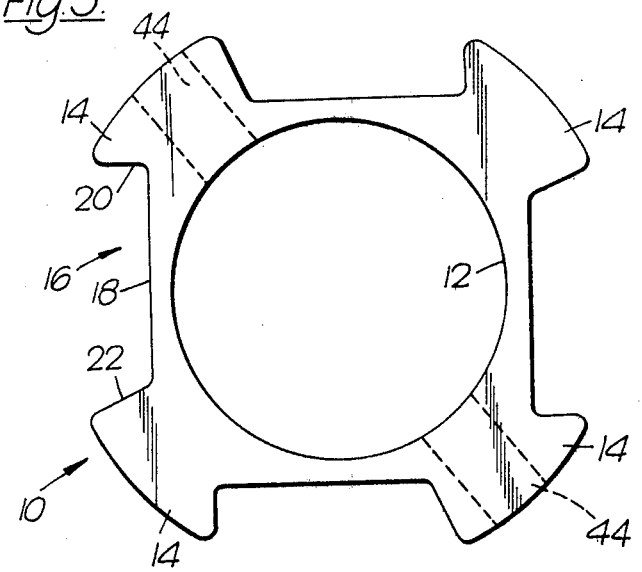
FIG. 3 is a plan view of the body member of the coupling.
Figure 4:
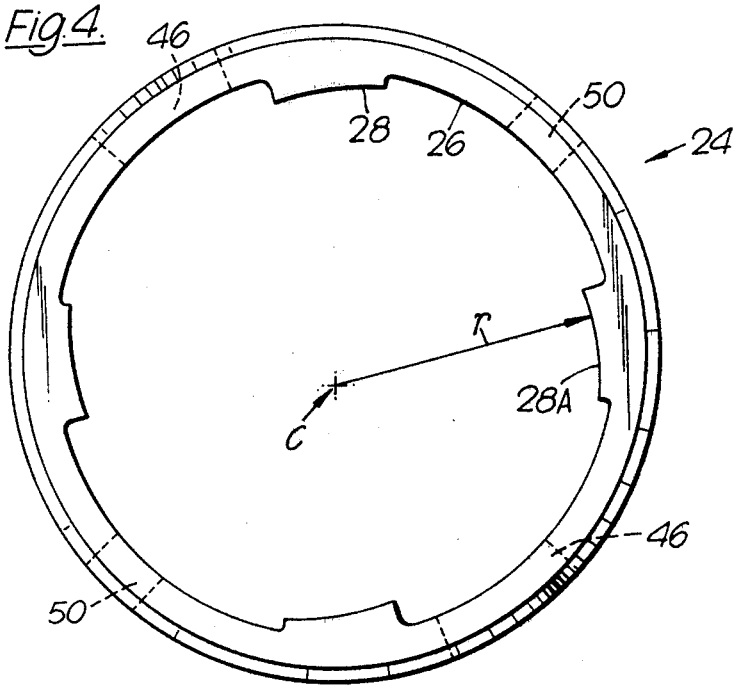
FIG. 4 is a plan view of the wedge ring member of the coupling.

The projection forming the wedging surface 28 restricts the rotational movement of the wedge ring between a maximum forward wedging position shown dotted in FIG. 2 at F and a maximum rear non-wedging position shown dotted in FIG. 2 at R; such a distance may be, e.g. ¾ inch though, when a peg 32 is located in the or each aperture, the wedge ring rotates forwardly only about, e.g. ½ inch. A peg can be inserted into the aperture when the ring is in or close to the non-wedging position; in a forward position of the ring the peg will be jammed in the aperture.

The boss 10 and wedge ring 24 are both mounted on a standard 40 by means of a pin 42 e.g. a "spirol" pin which is formed by rolling up a small square or rectangular metal sheet then rolling it up about its longitudinal axis. To permit this, the ring 24, boss 10 and standard 40 have diametrically opposed holes 44, 46, those in the boss passing through a pair of the projections 14. The holes 44, 46 in these three parts are alignable to permit the pin to be forcibly inserted. The pin is of a length such that its end 48 (FIG. 2) lie within the wedge ring, so to permit rotation of the ring 24; the diametral holes 46 therein are in the form of slots.

A second pair of diametral holes 50 are provided in the wedge ring 24 spaced at 90° to the pin-receiving slots 46. The second pair of holes 50 are round and receives a tool such as a C-spanner by which the ring can be rotated.

Figure 5:
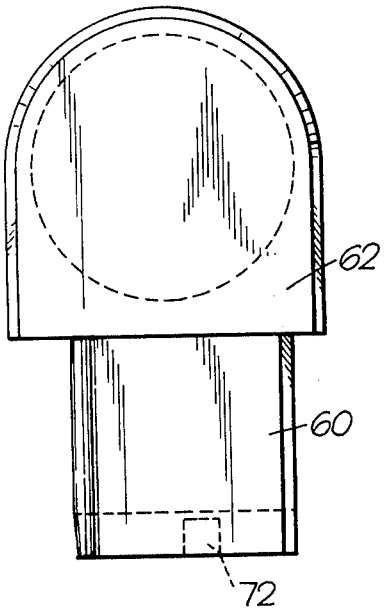
FIGS. 5 to 7 are front and side elevations and a plan view of the peg for location in the coupling.
Figure 6:
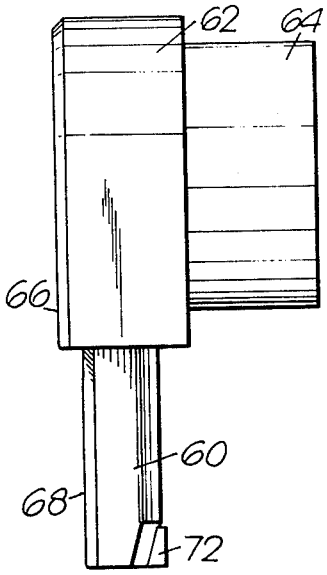
Figure 7:
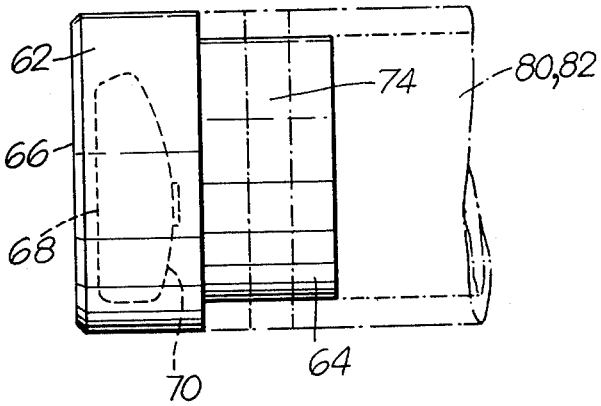

Referring now to FIGS. 5 to 7, each peg 32 comprises a shank 60 which is the part locatable in the aperture of the coupling and a head 62 which has a cylindrical projection 64 extending (rearwards) at right angles to the shank so as to extend radially away from the standard when the peg is located in the coupling. The head 62 and shank 60 both have a flat front face 66, 68, i.e. the side which faces the standard, and the shank has a convex rear face 70. The front face 68 is stepped so that the front face of the head will abut the standard and the lower face of the shank will abut the web in the aperture. A small projection or 'nib' 72 extends from the lower end of the convex face of each peg shank 60.

The cylindrical projection 64 of the head 62 is for location in the end of a piece of tubular ledger or transom scaffolding into which it is fixedly secured, e.g. by a spirol pin 74 of smaller diameter than pin 42.

In use, each piece of ledger 80 and transom 82 scaffolding has a peg in each end, the shanks of which are in parallel.

A number of couplings are connected to a standard 40 each by means of the spirol pin 42 as hereinbefore described; for example, pairs of holes may be pre-drilled in the standard. The pairs of holes in the standard may be spaced at intervals of 1'7½" or meter equivalent along the standard but it will be appreciated that couplings need only be mounted in every other pair, i.d. at 3'3" or meter equivalent intervals.

The wedge ring 24 is initially located in the un-wedging position so that a peg can be located in one or more of the radial apertures. When a peg is so located the nib 72 lies below the level of the wedge ring.

When the ring is rotated to the wedging position, e.g. using the C-spanner the nib 72 of each peg shank increases the holding effect because where the ledger or transom concerned receives an upward force tending to dislodge the peg the nib will abut the lower edge of the ring. In addition, the spirol pin 42 prevents such upward force tending to dislodge the ring 24.

The boss may have the following dimensions:
depth 1¼"
diameter 3¼"
central aperture 1.927"
length of inset web 1¼"
diametrical length between webs 2 3/16"
The wedge ring may have the following dimensions:
depth 1"
external diameter 3¾"
internal diameter 3¼"
distance of centre C from dead centre 3/16"
length of wedge 11/16"
Spirol pin:
length 3 11/16"
diameter ⅜"
The double sheer load for such a pin is 5$^{T}$12 cwt.

In a modification the coupling may be welded to the standard or by means of a pin which passes through only the boss and the standard; in these cases, means is provided to retain the ring on the boss, e.g. by a lower ledge on the boss and large headed screws located in the upper face of the boss to overlie the ring. Also, the wedge ring instead of having holes 50 may be provided with a radial projection or nose so that a ring can be rotated by giving the nose a sharp tap with a hammer.

The coupling may be pre-positioned on standards to individual or marked requirements. The ledgers and transoms can then be erected by locating their pegs in the four apertures in the coupling and rotating the wedge ring in the "forward" direction, e.g. using the C-spanner or by giving the nose of the ring a sharp tap with a hammer.

The parts of the coupling hereinbefore described may be made of metal or alloy such as by drop forging or die castings or shell castings or other material such as reinforced plastics or reinforced glass fibre or combinations thereof.

One main advantage of the coupling is the ease of securing ledgers and transoms to it, especially during overhead erecting, because they do not require to be bolted to the coupling.

Another important advantage of the coupling is that there are no loose fittings involved, the boss and ring being on the standards and the pegs being on the transom and ledger tubes. Consequently, costs will be reduced relative to orthodox scaffolding where a large number of clamps are required, many of which become lost or damaged on site.

Use of a pin is also advantageous in that the coupling can easily be removed from a damaged standard for re-use or to allow repairs to the standard, or replaced or repair of the coupling.

Finally, minimal bracings only will be required because the effect of the right-angle peg shank abutting the right-angled side of each inset on the boss creates complete right-angled alignment of the ledgers, transoms and standard.

Provision is made for producing a peg which will extend higher than normal, i.e. one in which the head will extend above the wedge ring more than in a normal peg. The purpose of such a peg is to compensate for the height between ledgers and transoms in existing scaffolding so that couplings as hereinbefore described may be used in conjunction with existing scaffolding.

In addition to their use with transom and ledger tubes, the pegs can be used with bracings to provide a swivel action facilitating erection of facade bracing; in such a case, tubular braces have flattened ends with transverse apertures in the ends. The cylindrical projections of the pegs located in these apertures and, while being held therein by a pin against removal, they are rotatable, thus allowing for angular adjustment of the bracing during erection.

I claim:

1. A coupling for tubular scaffolding comprising in combination, a body member for location around a standard, a wedge ring member which is co-planar and rotatably associated with the body member, and a plurality of pegs, the body member having a central aperture for receiving the standard therethrough and a plurality of radially disposed insets which combine with the wedge ring member to form radial apertures to receive the pegs therein parallel to the central aperture, the wedge ring member having a wedging surface for engaging the pegs when the ring member is rotated into a wedging position and for disengaging the pegs when the ring member is rotated into a disengaged position.

2. A coupling as claimed in claim 1, in which said wedge ring member has a wedging surface in the vicinity of each radial aperture which surface decreases the radial dimension of each radial aperture when the ring member is rotated into a wedging position.

3. A coupling as claimed in claim 1, in which the body member is mounted on a standard by means of a pin passing through diametral apertures in the body member and standard.

4. A coupling as claimed in claim 3, in which the wedge ring member has diametrically opposed slots in which the ends of the pin are located.

5. A coupling as claimed in claim 1, in which each peg comprises a shank and a head, the shank having a cross-section for location in the radial aperture and the head having a cylindrical extension extending at right angles to the shank for engaging a tubular ledger or transom.

6. A coupling as claimed in claim 5, in which the longitudinal axis of the shank is off-set relative to that of the head.

* * * * *